US006509525B2

(12) United States Patent
Honkomp et al.

(10) Patent No.: US 6,509,525 B2
(45) **Date of Patent: *Jan. 21, 2003**

(54) HERMETIC TERMINAL ASSEMBLY

(75) Inventors: Glenn A. Honkomp, Loveland, OH (US); Tariq Quadir, West Chester, OH (US); Stephanie S. Chapman, Cincinnati, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/075,102

(22) Filed: Feb. 11, 2002

(65) Prior Publication Data

US 2002/0148629 A1 Oct. 17, 2002

Related U.S. Application Data

(63) Continuation-in-part of application No. 09/583,436, filed on May 31, 2000, now Pat. No. 6,362,424, which is a continuation-in-part of application No. 09/188,161, filed on Nov. 7, 1998, now Pat. No. 6,107,566.

(51) Int. Cl.[7] ..... H01J 15/00

(52) U.S. Cl. ..... 174/50.52; 174/50.59; 174/152 GM; 174/50.63; 439/935

(58) Field of Search ..... 174/50.52, 50.59, 174/50.61, 50.63, 152 GM; 439/935, 926, 282, 685

(56) References Cited

U.S. PATENT DOCUMENTS

| | | | | |
|---|---|---|---|---|
| 2,517,023 A | | 8/1950 | Prakke | |
| 3,721,948 A | | 3/1973 | Brandt et al. | |
| 4,103,416 A | | 8/1978 | Sakamoto | |
| 4,296,275 A | | 10/1981 | Bowsky | |
| 4,461,925 A | | 7/1984 | Bowsky et al. | |
| 4,580,003 A | | 4/1986 | Bowsky et al. | |
| 4,584,433 A | | 4/1986 | Bowsky et al. | |
| 4,984,973 A | | 1/1991 | Itameci-Kinter et al. | |
| 5,117,089 A | | 5/1992 | Honkomp et al. | |
| 5,471,015 A | | 11/1995 | Paterek et al. | |
| 5,493,073 A | | 2/1996 | Honkomp | |
| 5,584,716 A | | 12/1996 | Bergman | |
| 5,675,122 A | | 10/1997 | Taylor | |
| 5,703,326 A | | 12/1997 | Yamada et al. | |
| 5,736,675 A | | 4/1998 | Michaels | |
| 6,107,566 A | | 8/2000 | Quadir et al. | |
| 6,114,633 A | * | 9/2000 | Duhancik | 174/152 GM |
| 6,362,424 B1 | * | 3/2002 | Honkomp et al. | 174/50.52 |
| 6,394,830 B1 | * | 5/2002 | Huang | 439/282 |

* cited by examiner

*Primary Examiner*—Dean A. Reichard
*Assistant Examiner*—Dhiru R Patel
(74) *Attorney, Agent, or Firm*—Harness, Dickey & Pierce, P.L.C.

(57) ABSTRACT

A hermetic terminal assembly including a body member with a bottom portion and a surrounding boundary or flange portion with at least one current conducting pin sealed in an opening in the bottom portion. The hermetic terminal assembly may include an over-surface stratum or disk disposed in close fit relation in said body member in facing relation with said bottom and flange portions and/or an electrically insulating coating.

27 Claims, 3 Drawing Sheets

HERMETIC TERMINAL ASSEMBLY

CROSS-REFERENCE TO RELATED APPLICATIONS

This application is a continuation-in-part of United States patent application Ser. No. 09/583,436 filed on May 31, 2000 now U.S. Pat. No. 6,362,424, which is a continuation-in-part of United States patent application Ser. No. 09/188,161 filed on Nov. 7, 1998, now U.S. Pat. No. No. 6,107,566. The disclosures of the above applications are incorporated herein by reference.

FIELD OF THE INVENTION

The present invention relates to hermetic terminal assemblies and more particularly to structure for hermetic terminal assemblies which allow for a more durable hermetic terminal assembly.

BACKGROUND OF THE INVENTION

In the hermetic terminal assembly art, a number of construction arrangements have been utilized to prevent conductive pins, which pins serve to conduct current to isolated drive sources such as drive motors, disposed in hermetically sealed compressor housing shells, from electrically shorting to surrounding electrically conductive areas such as the aforementioned housing shells of compressors. These past arrangements have included surrounding conductive pins with insulated over-surface collars or sleeves, such as the insulating extended sleeve arrangement 23 disclosed in U.S. Pat. No. 4,584,433, issued to B. Bowsky, et al. on Apr. 22, 1986 and the sleeve arrangement 17 disclosed in U.S. Pat. No. 5,471,015, issued to F. Dieter Paterek, et al. On Nov. 28, 1995. These two aforementioned patents were further concerned with conductive pin fusing and with pin design, respectively, attention being particularly directed to the aperture 36 in U.S. Pat. No. 4,580,003, issued to B. Bowsky et al. on Apr. 1, 1986 and to aperture 38 of flattened neck portion 37 of pin 17 above in U.S. Pat. No. 4,584,333, issued to B. Bowsky et. al. on Apr. 22, 1986, and to the relative coefficients of expansion and softening point temperatures in U.S. Pat. No. 5,471,015, issued to F. D. Paterek et. al. on Nov. 28, 1995.

In the present invention, an insulated disk member of select material provides the desirable over-surface construction, this disk member being held in fast position through a unique retention arrangement cooperative with the pin construction. In combination with the novel over-surface disk member, the present invention provides a unique, readily regulatable fuse-like pin construction. The arrangement set forth herein also is straightforward and economical in manufacture, assembly and maintenance, requiring a minimum of operating steps and parts in manufacture, assembly and maintenance.

Various other features of the present invention will become obvious to one skilled in the art upon reading the disclosure set forth herein.

BRIEF SUMMARY OF THE INVENTION

More particularly the present invention provides an arc resistant hermetic terminal assembly. The arc resistant terminal assembly includes a body having a bottom portion with an inner surface and a boundary portion with an inner surface. The boundary portion extends from a periphery of the bottom portion and the inner surfaces of the bottom and boundary portions define an interior of the body. The bottom portion has at least one opening extending therethrough. A current conducting pin extends through each of the at least one opening in the bottom portion. An electrical-arc-resisting member faces the inner surfaces of the bottom and boundary portions. The arc-resisting member resists electrical arcing within the interior between the pin and a portion of the body that is protected by the arc-resisting member. There is also an insulating pin seal that extends between and seals a periphery of the current conducting pin to a periphery of the at least one opening in the bottom portion.

The present invention also discloses a high-pressure hermetic terminal assembly. The high-pressure hermetic terminal assembly includes a body having a bottom portion with an inner surface and a boundary portion with an inner surface. The boundary portion extends from a periphery of the bottom portion and the inner surfaces of the bottom and boundary portions define an interior of the body. The bottom portion has at least one opening extending therethrough. A current conducting pin extends through each of the at least one opening in the bottom portion. A support member is attached to at least the inner surface of the bottom portion. The support member increases an effective modulus of elasticity of the bottom portion so that the body with the support member can withstand higher pressure than the body without the support member. There is also an insulating pin seal that extends between and seals a periphery of the current conducting pin to a periphery of the at least one opening in the bottom portion.

In addition, the present invention also discloses a chemically-resistant hermetic terminal assembly. The chemically-resistant hermetic terminal assembly includes a body having a bottom portion with an inner surface and a boundary portion with an inner surface. The boundary portion extends from a periphery of the bottom portion and the inner surfaces of the bottom and boundary portions define an interior of the body. The bottom portion has at least one opening extending therethrough. A current conducting pin extends through each of the at least one opening in the bottom portion. A chemically-resistant member covers a portion of at least one of the inner surface of the bottom portion and the inner surface of the boundary portion. The chemically-resistant member prevents dynamic contact between a fluid within the interior and the portion of the inner surfaces covered by the chemically-resistant member. There is also an insulating pin seal that extends between and seals a periphery of the current conducting pin to a periphery of the at least one opening in the bottom portion.

It is to be understood that various changes can be made by one skilled in the art in one or more of the several parts of the novel structural assembly disclosed herein without departing from the scope or spirit of the present invention.

BRIEF DESCRIPTION OF THE DRAWINGS

The present invention will become more fully understood from the detailed description and the accompanying drawings, wherein.

DETAILED DESCRIPTION OF THE INVENTION

The following description of the preferred embodiment(s) is merely exemplary in nature and is in no way intended to limit the invention, its application, or uses.

The hermetic terminal assembly of the present invention can be used in a variety of applications. For example, a typical application is on a compressor housing. Because the specific application in which the hermetic terminal assembly is used will vary, the engineering requirements will also vary. However, there are typical requirements for which the hermetic terminal assembly can be constructed. For example, typical minimum engineering requirements may include:

| Physical Property | Requirement |
|---|---|
| Hydrostatic Pressure | 2250 psi |
| Hermeticity | $1 \times 10^{-7}$ cc/sec He |
| Dielectric Voltage | Minimum 2500 V with <0.5 mA leakage |
| Insulation Resistance | >10,000 MΩ at 500 Vdc |
| Operating Temperature | 150° F. to 300° F. |
| Operating Environment | Mineral oil or refrigerant |

It should be understood that the above minimum engineering requirements are shown for exemplary purposes and that the actual minimum engineering requirements will vary depending upon the application in which the hermetic terminal assembly is employed. Therefore, the above listed minimum engineering requirements do not need to be met for a hermetic terminal assembly to be within the scope of the invention as defined by the claims.

Figure 1:
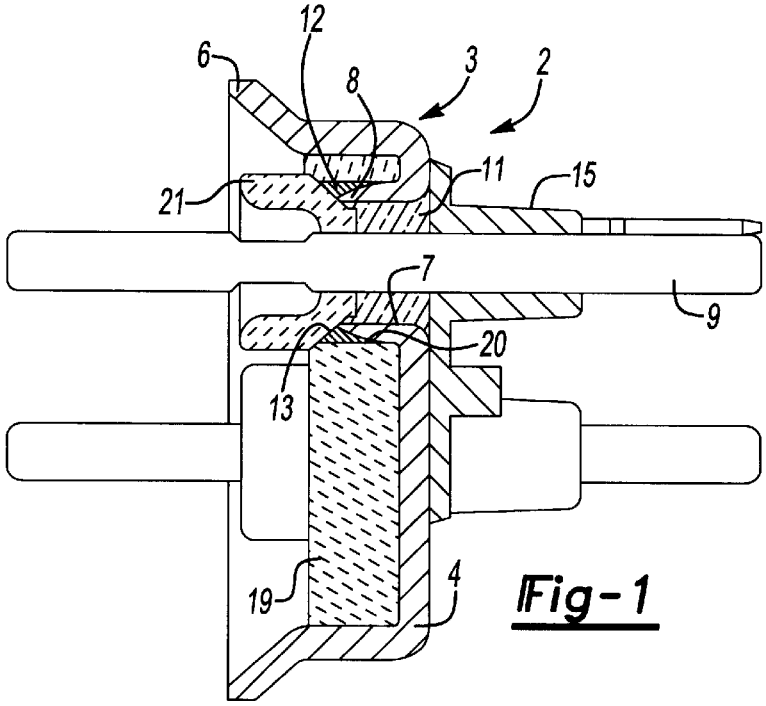
FIG. 1 is a schematic, cross-sectional view of a hermetic terminal assembly according to the principles of the present invention.
Figure 2:
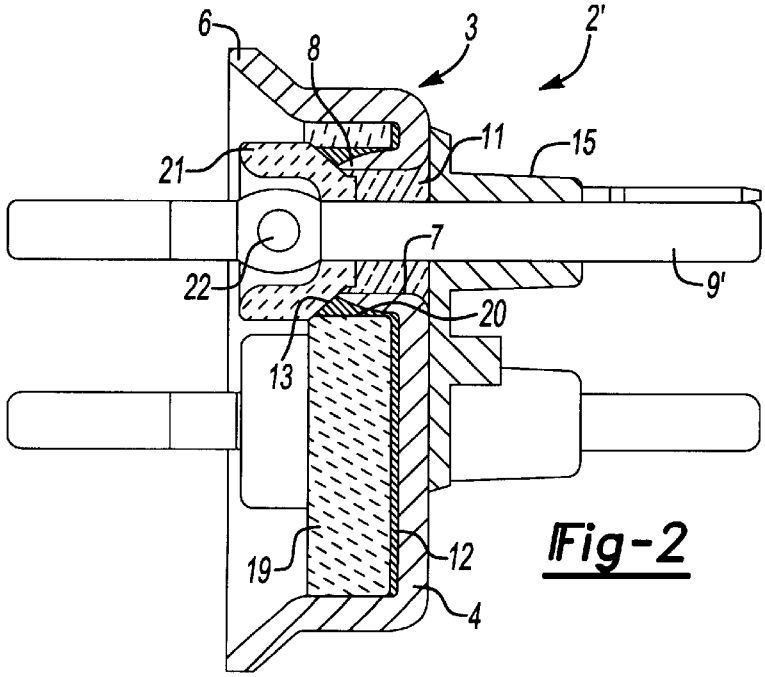
FIG. 2 is a schematic, cross-sectional view of another hermetic terminal assembly similar to that of FIG. 1 and incorporating an inventive fuse-like apertured pin in place of the conductive pin of FIG. 1 and a different stratum arrangement.

As can be seen in FIGS. 1 and 2 of the drawings, the hermetic terminal assemblies 2 and 2 each includes a metallic cup-shaped body member 3 which is of a preselected configuration and which is formed from cold rolled steel material—all as is generally well known in the art. Cup-shaped body member 3 includes a generally flat bottom portion 4 and a boundary portion 6, here disclosed in the form of an integral flange or sidewall extending along and outwardly from the periphery of bottom portion 4 to surround the inner surface of bottom portion 4. The inner surfaces of the bottom and boundary portions 4, 6 define an interior of the hermetic terminal assembly 2. As also is known in the art, bottom portion 4 is provided with three substantially equally spaced and equally sized openings 7 (only one of which can be seen in the terminal assemblies 2 and 2 (FIGS. 1 and 2). Each opening 7 is defined by an interior wall surface of annular lip 8, which lip is an integral part of cup-shaped body member 3 and which extends outwardly from the inner surface of bottom portion 4 to be within boundary or flange 6 of body member 3. A suitable electric current conductive pin 9 (FIG. 1) and 9 (FIG. 2) extends through each opening 7 with the peripheral, circumferential surface of each pin 9 (FIG. 1) and 9 (FIG. 2) being spaced in relation to the interior wall surface of annular lip 8 and each opening 7. A suitable insulating arrangement 15 made from an appropriate insulating material, such as rubber, is provided along conductive pins 9 and 9' extending from an outer surface of each cup-shaped body member 4 and surrounding a portion of each pin 9 and 9'.

An insulating glass seal 11 extends between the circumferential periphery of each pin 9 (FIG. 1) and 9' (FIG. 2) and the wall of the respective opening 7 and the interior wall surface of annular lip 8 to seal the pin 9 and 9' respectively in its body member 3 so as to be in insulated relation with the body member 3.

In accordance with one novel feature of the present invention as disclosed in different arrangements in FIGS. 1 and 2, an extended over-surface stratum or layer 12 (FIG. 2) of suitable insulating material such as ceramics—glass is provided. As such, stratum 12 can act as an electrical arc-resisting member. The stratum 12 can be attached to the inner surfaces of the body 3 by an adhesive (not shown), as is known in the art, or by a collar 21, discussed below. Stratum 12 can be of varying thickness, depending upon the environmental conditions involved, so as to be appropriately sized and configured in either wafer or disk form. The stratum 12 can include three openings 13, each opening correspondingly aligned with one of the openings 7 in the bottom portion 4 of body member 3 (only one such opening being disclosed in FIGS. 1 and 2 of the drawings). In this regard, it is to be noted that each stratum opening 13 is not only positioned to be correspondingly aligned with an opening 7 in the bottom portion 4 of cup-shaped body member 3, but the stratum opening 13 is further sized to engage in close fit proximate relationship with the outer periphery of annular lip 8. It also is to be noted that in FIG. 1, stratum 12 is disclosed only as a ring around each annular lip 8, it being understood that a bottom portion to face bottom portion 4 can be designed to be extremely thin or even eliminated with a suitable insulating adhesive being substituted therefor if desired, it is to be understood that in other unique and novel embodiments of the present invention, insulating stratums 12 and 13 as disclosed in FIGS. 1 and 2 and as described above can be eliminated and other insulating materials such as a hard, strong, resistant adhesive, like an epoxy or a polymeric resin can be utilized as disclosed in FIGS. 6 and 7—as described hereinafter.

The stratum 12 can also act as a chemically-resistant member by providing a chemically-resistant layer that protects the body 3 from corrosion caused by exposure to a fluid in the interior of the body 3. For example, in a typical application, the hermetic terminal assembly 2 is used on a compressor, such as one for use in HVAC applications. The hermetic terminal assembly is mounted on a compressor housing. The compressor housing may contain a fluid, such as a refrigerant and/or mineral oils, that flow or slosh throughout the compressor housing. When these fluids come in contact with the inner surfaces of the body 3 in this manner, they can promote corrosion of the body 3. The stratum 12, when made from an appropriate material provides protection for the inner surfaces of the body 3 on which the stratum 12 is attached. Therefore, as can be seen in FIG. 2, the stratum 12 provides protection for the inner surface of the bottom portion 4 and the annular lip 8. It should be understood that the stratum 12 can also extend along an inner surface of the boundary portion 6 to protect the inner surface of the boundary portion 6 from chemical corrosion caused by exposure to fluids in the interior of the body 3.

The stratum 12 can also enhance the pressure rating of the hermetic terminal assembly 2 by acting as a support member. The stratum 12 is attached to the bottom portion 4 of the body 3. The attachment of the stratum 12 to the bottom portion 4 enhances the strength of the bottom portion 4 and enables the bottom portion 4 to withstand a higher-pressure environment. That is, the bottom portion 4 has a modulus of elasticity that is increased by the attachment of the stratum 12 to the bottom portion 4. The result of attaching the stratum 12 to the bottom portion 4 is an overall effective modulus of elasticity for the bottom portion 4 that is greater than the modulus of elasticity of the bottom portion 4 without the attached stratum 12. This enables the hermetic terminal assembly 2 to withstand a higher-pressure environment than prior hermetic terminal assemblies without this feature.

Figure 4:
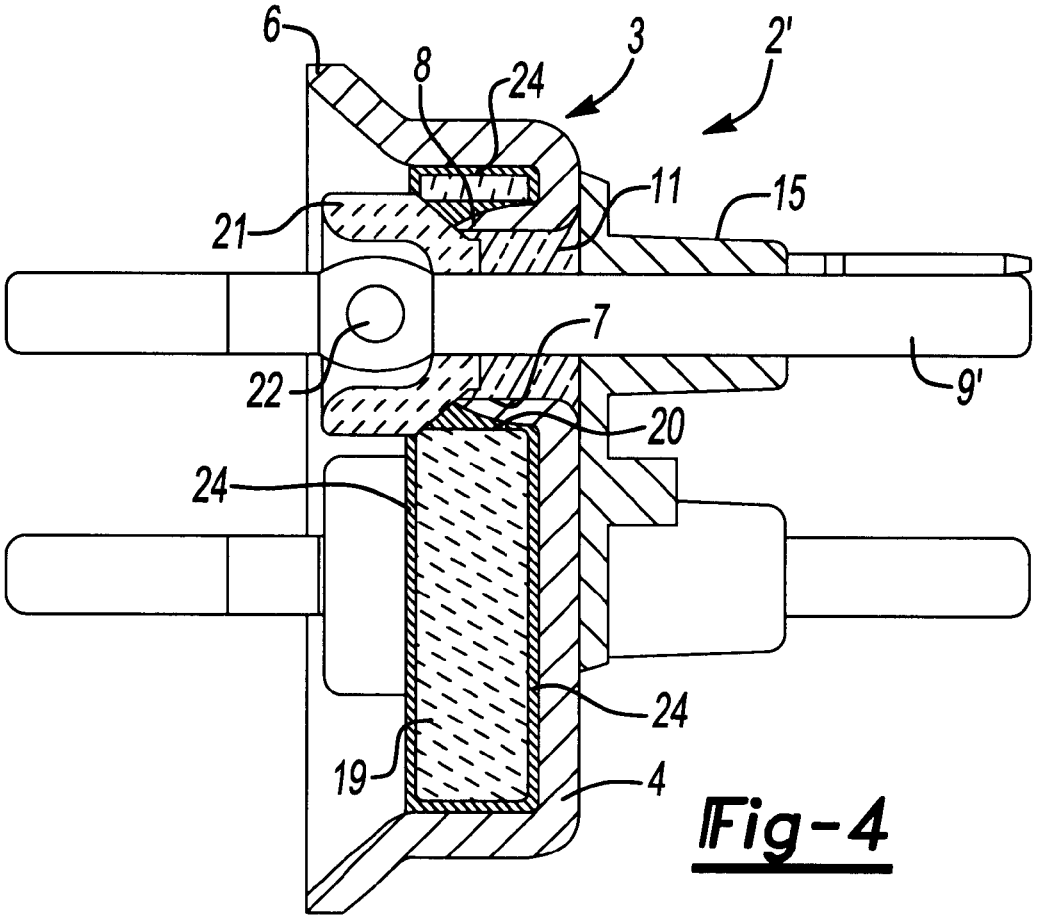
FIG. 4 is a schematic, cross-sectional view of a hermetic terminal assembly according to the principles of the present invention, similar to FIG. 2, showing the use of a coating to cover a portion of the inner surfaces of the body and a portion of the disk in place of the stratum layer.

In the inventive embodiments of FIGS. 1 and 2, a novel, over-surface disk 19 of non-porous ceramic insulating material is disclosed as engaging the inner surface of bottom portion 4 of cup 3 (FIG. 1) or the stratum 12 (FIG. 2), a thermal spray coating 24 (FIG. 4) or an epoxy layer 30 (FIGS. 5 and 6) as well as the inner surface of boundary or flange portion 6 of cup-shaped body member 3 so as to be in close fit proximate relationship with these body member portions. The ceramic disk 19 can be made from a variety of materials. For example, the ceramic disk 19 can be made from material such as silicon nitride ($Si_3N_4$), aluminum nitride (AlN), or zirconium oxide ($ZrO_2$). The disk 19 can have one or more openings 20 (only one shown) that align with the openings 7 in the bottom portion 4 so that the pin 9 can extend therethrough. As above discussed, bottom portion 4 of FIG. 1 is provided with openings 7 (only one shown), each opening 7 including associated integral annular lip 8, current conducting pin 9 and glass seal 11. In the inventive disclosure of FIGS. 1 and 2 herein, the hermetic terminal assembly 2 does not employ liquid epoxy adhesives or crowns to maintain the stratums 12 and 13 or ceramic disk 19 with its corresponding openings in close fit proximate relationship to cup-shaped body member 3, as described in the above mentioned co-pending patent application. To accomplish over-surface ceramic disk retention in the embodiments of FIGS. 1, 2, and 4, tapered insulated collars or sleeves 21 which also can be of a suitable non-porous insulating ceramic material can be provided to surround and accommodate passage therethrough of current conducting pins 9 (only one shown). Each insulating collar 21, as can be seen in FIGS. 1, 2, and 4, has one end sealed in fast relation to the insulating glass seal 11 and the opposite collar end extending beyond the periphery of ceramic disk 19 opening 20 (correspondingly aligned with opening 7 of bottom portion), the outwardly extending neck portion of such opposite end abuttingly engaging the surrounding surface of the opening 20 in disk 19. Thus, the ceramic disk 19 can be held in fast position without the aforedescribed crowns and epoxy or polymeric resins as hereinafter described for the novel arrangements of FIGS. 5 and 6. It is to be understood that in this embodiment of the invention, the close fit relation between disk 19 and the body portions 4 and 6 of body member 3 can be enhanced by tine-sizing and with knurling at selected areas it indicated, along with an appropriate press fitting if desired and with the use of appropriate sealing materials wherever required.

In a typical application in which the hermetic terminal assembly 2 is used, the interior of the hermetic terminal assembly 2 faces an operating environment in which electrically conducting debris or other similar contaminates can be deposited on the interior of the hermetic terminal assembly 2. For example, when the hermetic terminal assembly 2 is used on a compressor housing, the interior of the hermetic terminal assembly 2 is exposed to moving parts and/or an operating fluid. The moving parts and/or the operating fluid can cause electrically conducting debris or other similar contaminates to be deposited on the interior of the hermetic terminal assembly 2. The electrically conducting debris may cause electrical arcing to occur between the pin 9 and the debris. The electrical arcing can then pass through the debris and onto the body 3 of the hermetic terminal assembly 2 and cause severe damage to the body 3 and possibly a failure of the hermetic seal. Therefore, it is important to prevent or at least minimize the potential an electrical arc passing to the body 3 of the hermetic terminal assembly 2.

The disk 19 can help prevent and/or minimize damage caused by electrical arcing in the interior of the hermetic terminal assembly 2 by acting as an electrical arc-resisting member. That is, the disk 19 electrically insulates the components of the hermetic terminal assembly 2 and can prevent electrical arcing between the pin 9 and the body 3. The typical electrical arc within the hermetic terminal assembly 2 can produce temperatures up to approximately 4000 degrees Fahrenheit and voltages up to approximately 4300 volts. The disk 19 is preferably made from a ceramic material. Ceramic materials exhibit a high ablation resistance and can withstand the high temperature and voltage associated with the electrical arc within the hermetic terminal assembly 2. The disk 19 thereby inhibits the electrical arc from progressing pass the disk 19 and protects the body 3 from being destroyed by electrical arcing within the hermetic terminal assembly 2.

The disk 19, can also be used to provide a hermetic terminal assembly 2 that is capable of withstanding high pressures by acting as a support member. As was discussed above with reference to the stratum 12, the disk 19 can also increase an overall effective modulus of elasticity of the body 3 by being attached to the bottom portion 4. That Is, the disk 19 can be attached to the bottom portion 4 by an adhesive or other suitable means and increase the stiffness of the bottom portion 4 and increase an overall effective modulus of elasticity of the bottom portion 4. The disk 19 can greatly enhance the overall effective modulus of elasticity of the bottom portion 4 because the ceramic disk 19 has a modulus of elasticity that is approximately double that of the steel body 3. The disk 19 can be used in conjunction with the stratum 12 (along with suitable retaining means, such as adhesives to hold the disk 19 and the stratum 12 to the bottom portion 4) to increase the overall effective modulus of elasticity of the bottom portion 4 and allow the hermetic terminal assembly 2 to operate in a higher-pressure environment that the body 3 can withstand without the aid of the disk 19 and/or stratum 12.

Figure 5:
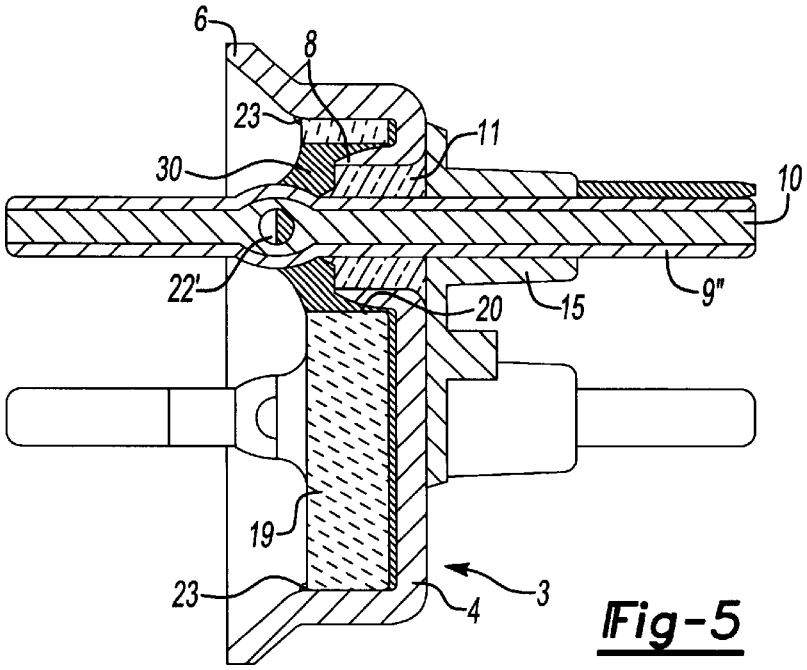
FIG. 5 is a schematic, cross-sectional view of a hermetic terminal assembly according to the principles of the present invention similar to FIG. 1, disclosing a pin formed with a differing core metal such as in FIG. 3 and substituting an epoxy material for the ceramic collar surrounding a conductive pin and for the stratum layer.
Figure 6:
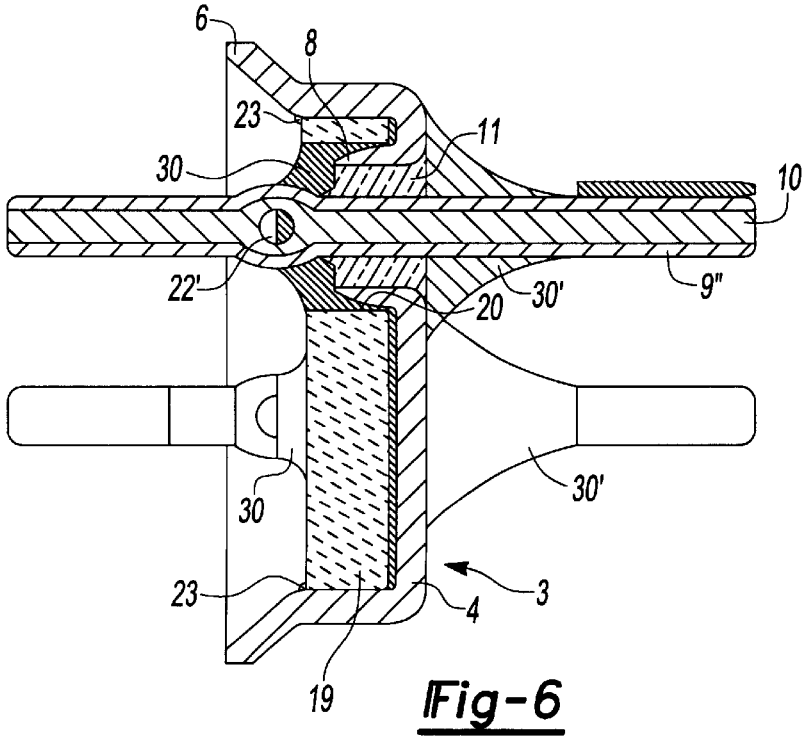
FIG. 6, is a schematic, cross-sectional view of a hermetic terminal assembly according to the principles of the present invention, also similar to FIGS. 1 and 5, substituting an epoxy material surrounding a conductive pin both within a boundary portion of a cup shaped body member as in FIG. 5 and in place of a pin insulator, such as rubber (FIG. 5) along a portion of a conductive pin extending from an outer surface of a cup shaped body member.

The disk 19, like the stratum 12, can also be used to provide a chemically-resistant hermetic terminal assembly 2 by acting as a chemically-resistant member. The disk 19 is preferably made from a chemically resistant ceramic. As a result, the disk 19 can protect the portions of the body 3 which are covered by the disk 19. The disk 19, as can be seen in FIGS. 5 and 6, can be sealed around its periphery to the boundary portion 6 by a suitable adhesive 23. The adhesive 23 seals the disk 19 to the boundary portion 6 and prevents fluid within the interior of the hermetic terminal assembly 2 from coming in contact with the portion of the body 3 that is protected by the disk 19. The prevention of the fluid from coming in contact with the body 3 protects the body from chemical corrosion. When the disk 19 is not sealed to the body 3, the disk 19 still provides protection of the body 3 against chemical corrosion by preventing dynamic contact between the fluid and the body 3. That is, when the disk 19 is not sealed to the body 3, some fluid may seep between the disk 19 and the body 3 but that fluid will not be in dynamic contact with the portion of the body 3 behind the disk 19. The term dynamic contact is to be understood to mean the fluid actively sloshing, splashing or exhibiting turbulent flow against the body 3. Dynamic contact is to be differentiated from and does not include the case of the fluid seeping between the disk 19 and the body 3 and/or gravity flowing across the body 3. By preventing dynamic contact between the fluid and the body 3, chemical corrosion can be greatly reduced and/or eliminated. Thus, the disk 19 can be used to provide a hermetic terminal assembly 2 that is chemically resistant.

It further is to be understood that for hermetic terminal assemblies such as disclosed, the non-porous ceramic disk 19 (of FIGS. 1, 2, and 4-6) which inhibits deposition of electrically shorting materials can be of a thickness in the range of approximately zero point one five (0.15) to zero point two zero (0.20) inches and advantageously of approximately zero point one eight (0.18) inches. In addition, in keeping with the ceramic disk retention concept of the present invention, the disk 19 can be retained in position by an extension of glass seal 11 into sealing relation with the peripheral wall of ceramic disk opening 20 or by incorporating a collar-like extension portion on ceramic disk 19 which can engage annular lip 8 in sealed relation with glass seal 11. In either of these instances, the insulating collar 21, as shown, would be eliminated.

Further, it is to be understood that ceramic disk 19, the inner surfaces of the body 3 and/or the ceramic sleeve 21 can be covered with a suitable thermal spray coating 24 to provide a further protective insulating surface. For example, as shown in FIG. 4, the coating 24 can be applied to the inner surfaces of the bottom and boundary portions 4, 6 and to the disk 19. Such a thermal spray coating can incorporate one or more suitable materials such as aluminum oxide ($Al_2O_3$), Ytria stabilized zirconia (YTZP), Forsterite or Steatite or monolithic disk material such as silicon nitride ($Si_3N_4$), aluminum nitride (AlN), or zirconium oxide ($ZrO_2$) As such, the coating 24, like the disk 19, can act as an electrical arc-resisting member by helping resist electrical arcing within the interior of the hermetic terminal assembly 2. That is, the coating 24 can be applied to a portion of the inner surfaces of the body 3 and prevent an electrical arc from passing through the coating 24 and to the portion of the body 3 protected by the coating 24. The coating 24 can be used alone or in conjunction with the disk 19 to provide resistance to electrical arcing within the hermetic terminal assembly 2.

Figure 3:
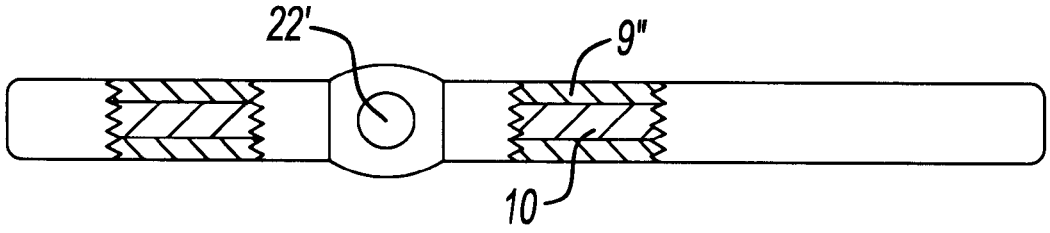
FIG. 3 is a schematic, partially broken-away cross-sectional plan view of an apertured conductive pin formed with a differing core metal, which pin can be employed with the terminal assembly of FIGS. 1 and 2 instead of those disclosed.

Referring specifically to FIGS. 2 and 3 of the drawings, apertured conductive pins 9' (FIG. 2) and 9" (FIG. 3) are disclosed. These pins have a preselected length and a preselected cross-sectional area with the conductive pins associated with hermetic terminal assemblies such as those described above having a length of approximately one and seven eighths (1⅞) inches and an overall diameter of approximately zero point one two five (0.125) inches. The pins 9 and 9', as disclosed in FIGS. 1 and 2, can be formed completely from an electrically conductive alloyed metal such as stainless steel or can include a different core metal 10 of a lower melting point, such as copper, as disclosed for pin 9" in FIG. 3. As can be seen in FIGS. 2 and 3 of the drawings, fuse-like apertures 22 and 22' in pins 9' and 9" respectively are disclosed. These apertures 22 (FIG. 2) and 22' (FIG. 3) are provided with a smooth peripheral surface to avoid premature burn-off and are disposed along the longitudinal axis of pins 9' and 9" respectively to be a carefully regulated preselected distance from one extremity of the pin, depending upon the nature of the use of the pin.

In FIGS. 5 and 6, metallic core pins 9", such as disclosed in FIG. 3 of the drawings, are shown extending respectively through cup-shaped body members 3 and sealed thereto in a manner similar to the arrangements of FIGS. 1 and 2, each arrangement of these two FIGS. 5 and 6 including the novel ceramic disk 19 with both arrangements not incorporating stratum arrangements 12 and 13 as shown in FIGS. 1 and 2. Instead, in FIG. 5, a hard, strong, resistant adhesive coating 30, such as suitable polymeric or epoxy resin, is disclosed within boundary 6 of cup-shaped body member 3 sealingly abutting and fastened between the outer surface of lip 8 and the inner surface of an aperture in ceramic disk 19 which accommodates passage of pin 9" there through. Coating 30 further adheres to and covers the inner surface of glass seal and adheres to a portion of the outer perimeter of conductive pin 9" extending through an appropriate aperture in cup-shaped body member 3. The coating 30 can also extend along the inner surface of the bottom portion 4 and the inner surface of the boundary portion 6. The coating 30 can be used to adhere the disk 19 to the body 3. A similar novel sealing arrangement can be seen in FIG. 6 of the drawings along the inner surface of cup-shaped body member 3. However, in the arrangement of FIG. 6, in place of the rubber insulating arrangement 15 extending from the outer surface of cup-shaped body member to surround each pin, an outer adhesive epoxy coating 30', like the material of inner coating 30 can be provided in place of the rubber insulating arrangement 15. It is to be understood that other conductive pins, besides the core pins 9" such as shown in FIGS. 5 and 6 can be employed with the novel arrangements of FIGS. 5 and 6. Further, it is to be understood that in place of the epoxy coating 30 and 30' disclosed in FIGS. 5 and 6, it would be possible to employ a collar or sleeve made of an electrically insulating thermoset epoxy powder which, after heating is applied, melts and cures to harden in fast relation to glass seal 11, current conducting pin 9' or 9" and ceramic disk 19 to hold disk 19 in fast position. Further, a two-part liquid, electrically insulating thermoset epoxy resin can be employed which, after heating, will cross-link to cure and harden in similar, fast relation to glass seal 11, pin 9' or 9", and ceramic disk 19.

The coating 30, like the stratum 12 and disk 19, can increase the ability of the hermetic terminal assembly 2 to withstand high pressures by acting as a support member. The coating 30 can be applied to the inner surface of the bottom portion 4 which will tend to add to the stiffness of the bottom portion 4 and thereby increase the overall modulus of elasticity of the bottom portion 4. The resulting increased modulus of elasticity allows the hermetic terminal assembly 2 to withstand higher pressures than without the coating 30.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An arc-resistant hermetic terminal assembly comprising:

a body having a bottom portion with an inner surface and a boundary portion with an inner surface, said boundary portion extending from a periphery of said bottom portion, said inner surfaces of said bottom and boundary portions defining an interior of said body, and said bottom portion having at least one opening extending therethrough;

a current conducting pin extending through said at least one opening in said bottom portion;

an electrical-arc-resisting member facing said inner surfaces of said bottom and boundary portions, said arc-resisting member resisting electrical arcing within said interior of said body between said pin and a portion of said body protected by said arc-resisting member; and an insulating pin seal extending at least between and sealing a periphery of said current conducting pin to a periphery of said at least one opening in said bottom portion.

2. The arc-resistant hermetic terminal assembly of claim 1, wherein:

said arc-resisting member surrounds said at least one opening in said bottom portion.

3. The arc-resistant hermetic terminal assembly of claim 1, wherein:

said arc-resisting member is a coating that coats a portion of said inner surface of said bottom portion.

4. The arc-resistant hermetic terminal assembly of claim 3, wherein:

said coating covers an entire inner surface of said bottom portion.

5. The arc-resistant hermetic terminal assembly of claim 4, wherein:

said coating covers a portion of said inner surface of said boundary portion.

6. The arc-resistant hermetic terminal assembly of claim 3, wherein:

said coating incorporates a material selected from a group consisting of ytrla stabilized zirconia, forsterite, steatite, silicon nitride, aluminum nitride and zirconium oxide.

7. The arc-resistant hermetic terminal assembly of claim 1, wherein:

said arc-resisting member is a disk of insulating material.

8. The arc-resistant hermetic terminal assembly of claim 7, wherein:

said disk is made from a ceramic material.

9. The arc-resistant hermetic terminal assembly of claim 8, wherein:

said ceramic disk is made from a material selected from a group consisting of silicon nitride, aluminum nitride and zirconium oxide.

10. The arc-resistant hermetic terminal assembly of claim 7, wherein:

said disk has at least one opening that is aligned with said at least one opening in said bottom portion with said current conducting pin extending therethrough, and said disk surrounds said at least one opening in said bottom portion.

11. The arc-resistant hermetic terminal assembly of claim 7, further comprising:

a disk retention means to maintain said disk in close fit proximate position with respect to said inner surfaces of said bottom and boundary portions.

12. The arc-resistant hermetic terminal assembly of claim 7, further comprising:

a coating of an electrically insulting material, said coating covering at least a portion of said disk to further resist electrical arcing within said interior between said current conducting pin and said portion of said body protected by said disk.

13. The arc-resistant hermetic terminal assembly of claim 7, further comprising:

a coating of an electrically insulting material, said coating covering at least a portion of said inner surface of said bottom portion to further resist electrical arcing within said interior between said current conducting pin and said portion of said inner surface covered by said coating.

14. A high-pressure hermetic terminal assembly comprising:

a body having a bottom portion with an inner surface and a boundary portion with an inner surface, said boundary portion extending from a periphery of said bottom portion, said inner surfaces of said bottom and boundary portions defining an interior of said body, and said bottom portion having at least one opening extending therethrough;

a current conducting pin extending through said at least one opening in said bottom portion;

a support member attached to at least said inner surface of said bottom portion, said support member increasing an effective modulus of elasticity of said bottom portion so that said body with said support member can withstand higher pressure than said body without said support member; and an insulating pin seal extending at least between and sealing a periphery of said current conducting pin to a periphery of said at least one opening in said bottom portion.

15. The high-pressure hermetic terminal assembly of claim 14, wherein:

said support member is a stratum layer attached to at least said inner surface of said bottom portion.

16. The high-pressure hermetic terminal assembly of claim 14, wherein:

said support member Is a disk of non-porous insulating material that is attached to at least said inner surface of said bottom portion, said disk having at least one opening that is aligned with said at least one opening in said bottom portion with said current conducting pin extending therethrough.

17. The high-pressure hermetic terminal assembly of claim 16, wherein:

said disk is attached to said inner surface of said bottom portion and to a portion of said inner surface of said boundary portion.

18. The high-pressure hermetic terminal assembly of claim 16, wherein said support member further comprises:

a stratum layer disposed between said disk and at least said inner surface of said bottom portion, said stratum layer attaching said disk to at least said inner surface of said bottom portion.

19. The high-pressure hermetic terminal assembly of claim 16, wherein said support member further comprises:

an epoxy adhesive disposed between said disk and at least said inner surface of said bottom portion, said epoxy adhesive attaching said disk to at least said inner surface of said bottom portion.

20. A chemically-resistant hermetic terminal assembly comprising:

a body having a bottom portion with an inner surface and a boundary portion with an inner surface, said boundary portion extending from a periphery of said bottom portion, said inner surfaces of said bottom and boundary portions defining an interior of said body, and said bottom portion having at least one opening extending therethrough;

a current conducting pin extending through said at least one opening in said bottom portion;

a chemically-resistant member covering a portion of at least one of said inner surface of said bottom portion and said inner surface of said boundary portion, said chemically-resistant member preventing dynamic contact between a fluid within said interior of said body and said portion of said Inner surfaces covered by said chemically-resistant member; and an insulating pin seal extending at least between and sealing a periphery of said current conducting pin to a periphery of said at least one opening in said bottom portion.

21. The chemical-resistant hermetic terminal assembly of claim 20, wherein:

said chemically-resistant member is a chemically-resistant stratum layer attached to at least said inner surface of said bottom portion.

22. The chemically-resistant hermetic terminal assembly of claim 21, wherein:

said chemically-resistant stratum layer is attached to at least a portion of said inner surface of said boundary portion.

23. The chemically-resistant hermetic terminal assembly of claim 20, wherein:

said chemically-resistant member is a chemically-resistant disk that covers a portion of said Inner surface of said bottom portion, said disk having at least one opening that is aligned with said at least one opening in said bottom portion with said current conducting pin extending therethrough.

24. The chemically-resistant hermetic terminal assembly of claim 23, wherein:

said disk covers a portion of said inner surface of said boundary portion.

25. The chemically-resistant hermetic terminal assembly of claim 24, wherein:

a sealant is disposed along a periphery of said disk, said sealant sealing said periphery of said disk to said inner surface of said boundary portion.

26. The chemically-resistant hermetic terminal assembly of claim 23, wherein:

a stratum layer is disposed between said disk and at least said inner surface of said bottom portion, said stratum layer attaching said disk to at least said inner surface of said bottom portion.

27. The chemically-resistant hermetic terminal assembly of claim 23, wherein:

an epoxy adhesive is disposed between said disk and at least said inner surface of said bottom portion, said epoxy adhesive attaching said disk to at least said inner surface of said bottom portion.

* * * * *